US009788103B2

(12) United States Patent
Risberg

(10) Patent No.: US 9,788,103 B2
(45) Date of Patent: Oct. 10, 2017

(54) SPEAKER SYSTEM WHICH COMPRISES SPEAKER DRIVER GROUPS

(75) Inventor: Pär Gunnars Risberg, Solna (SE)

(73) Assignee: Cirrus Logic International Semiconductor Ltd., Edinburgh (GB)

( * ) Notice: Subject to any disclaimer, the term of this patent is extended or adjusted under 35 U.S.C. 154(b) by 552 days.

(21) Appl. No.: 13/820,347

(22) PCT Filed: Sep. 1, 2011

(86) PCT No.: PCT/SE2011/051055

§ 371 (c)(1),
(2), (4) Date: May 13, 2013

(87) PCT Pub. No.: WO2012/030292

PCT Pub. Date: Mar. 8, 2012

(65) Prior Publication Data

US 2013/0236031 A1 Sep. 12, 2013

Related U.S. Application Data

(60) Provisional application No. 61/379,755, filed on Sep. 3, 2010.

(30) Foreign Application Priority Data

Sep. 3, 2010 (SE) ..... 1050907

(51) Int. Cl.
*H04R 1/24* (2006.01)
*H04R 1/40* (2006.01)
*H04R 1/26* (2006.01)

(52) U.S. Cl.
CPC ..... *H04R 1/24* (2013.01); *H04R 1/26* (2013.01); *H04R 1/403* (2013.01);
(Continued)

(58) Field of Classification Search
None
See application file for complete search history.

(56) References Cited

U.S. PATENT DOCUMENTS 5,764,782 A 6/1998 Hayes
6,834,113 B1 * 12/2004 Liljehag ..... H04R 5/02 181/144

(Continued)

FOREIGN PATENT DOCUMENTS

EP 1871143 A1 12/2007
JP 2008134422 A 12/2008

(Continued)

OTHER PUBLICATIONS

Norcross, Scott G., Soulodre, Gilbert A., and Lavoie, Michel C., "Subjective Investigations of Inverse Filtering", Oct. 2004, J. Audio Eng. Soc.; vol. 52, pp. 1003-1028.*

(Continued)

*Primary Examiner* — Curtis Kuntz
*Assistant Examiner* — Kenny Truong
(74) *Attorney, Agent, or Firm* — Michael G. Johnston; Moore & Van Allen PLLC

(57) ABSTRACT

A speaker system (1, 1', 1") comprises a first speaker driver group (G1), comprising at least one first speaker driver (S1) and a first amplifier (A1), and a second speaker driver group (G2), comprising at least one second speaker driver (S2) and a second amplifier (A2). The speaker system further comprises a digital signal processor (2), adapted to provide a first signal to the first speaker driver group (G1) and a second signal to the second signal group (G2), wherein the first and second signals differ with respect to frequency range and at least one of the speaker driver groups comprises at least 4, 6, 8 or 10 speaker drivers.

19 Claims, 2 Drawing Sheets

(52) U.S. Cl.
CPC .. *H04R 2201/028* (2013.01); *H04R 2201/401* (2013.01); *H04R 2201/405* (2013.01); *H04R 2205/022* (2013.01)

(56) References Cited

U.S. PATENT DOCUMENTS

| | | | | |
|---|---|---|---|---|
| 2002/0146138 | A1 | 10/2002 | Kolano et al. | |
| 2006/0153407 | A1* | 7/2006 | Keele et al. | 381/182 |
| 2006/0182298 | A1* | 8/2006 | Stiles et al. | 381/335 |
| 2006/0204022 | A1* | 9/2006 | Hooley et al. | 381/117 |
| 2006/0251271 | A1 | 11/2006 | Grimani | |
| 2007/0086606 | A1 | 4/2007 | Goodwin | |
| 2008/0159545 | A1* | 7/2008 | Takumai | H04R 1/403 381/17 |
| 2008/0212805 | A1* | 9/2008 | Fincham | 381/160 |
| 2011/0038494 | A1* | 2/2011 | Graber | H04R 1/403 381/182 |

FOREIGN PATENT DOCUMENTS

| | | | |
|---|---|---|---|
| WO | 03034780 | A2 | 4/2003 |
| WO | 2010091999 | A1 | 8/2010 |

OTHER PUBLICATIONS

Pär Gunnars Risberg, International Application No. PCT/SE2011/051055, International Search Report, Dec. 23, 2011.
Actiwave AB, European Patent Application No. 11822227.2, Extended European Search Report, Oct. 21, 2015.
Frank, W., et al., Loudspeaker Nonlinearities—Analysis and Compensation; Signals, Systems and Computers, Conference Record of the Twenty-Sixth Asilomar Conference on Pacific Grova, CA, USA, Oct. 26-28, 1992, pp. 756-760, IEEE Comput. Soc.

* cited by examiner

SPEAKER SYSTEM WHICH COMPRISES SPEAKER DRIVER GROUPS

TECHNICAL FIELD

The present disclosure relates to a speaker system, finding particular use when included in flat speakers, i.e. speakers which are relatively thin, as seen in an axial direction.

Such speakers may be mountable on e.g. a wall and provide for increased freedom in the design of the speakers.

BACKGROUND

The development of ever thinner TVs and displays, using technologies such as LCD, plasma and LED, have made these devices wall mountable to a completely different extent than C7RT based TVs and displays.

However, modern users desire not only a good picture quality, but also good sound quality. The most common speaker drivers, "dynamic loudspeakers", typically present a dependency between speaker area and thickness: the larger speaker area—and thus ability to handle (with good quality) long wavelengths—the larger the thickness of the speaker driver.

Hence, providing a speaker, which is able to match the thickness of the modern TV or display, and which is able to provide good sound quality, has become a challenge.

One approach is to use other speaker driver technologies, such as electrostatic loudspeakers, distributed mode loudspeakers, flat panel loudspeakers, ribbon and planar magnetic loudspeakers or bending wave loudspeakers.

However, these speaker types are all associated with various restrictions and/or problems, which need to be taken account of when designing a speaker system, and which increase the cost and/or complexity of the speaker system.

It is thus desirable to provide a speaker system, which can achieve good sound quality in a thin cabinet and which can be produced at a low cost.

SUMMARY

Hence, it is an object of the present disclosure to provide a speaker system, which can be included in a thin cabinet, which can be produced at a low cost and achieve good sound quality. The invention is defined by the appended independent claims. Embodiments are set forth in the dependent claims, in the following description and in the drawings.

According to a first aspect, there is provided a speaker system, comprising a first speaker driver group, comprising at least one first speaker driver and a first amplifier, and a second speaker driver group, comprising at least one second speaker driver and a second amplifier. The speaker system further comprises a digital signal processing device, such as a digital signal processor (DSP), adapted to provide a first signal to the first speaker driver group and a second signal to the second speaker driver group. The first and second signals differ with respect to frequency range and at least one of the speaker driver groups comprises at least 4, 6, 8 or 10 speaker drivers.

A "frequency range" is understood as a frequency interval with a unique combination of a lowest and highest frequency. Hence, two speaker driver groups may be provided with more or less overlapping frequency ranges. It is also possible to provide two of the speaker driver groups with the same frequency range, optionally in combination with a difference in delay and/or phase shift.

In the system, different speaker driver groups may be used to operate in different frequency intervals. By selecting a suitable number of speaker drivers for each group, it is possible to cause each group to move as much air as a single, larger, speaker driver would have done.

A radius and a depth of the speaker drivers of at least one speaker driver group may be approximately equal, or differs less than about 50%, less than about 25%, less than about 15% or less than about 5%.

The speaker drivers of said at least one speaker driver group may present a radius less than about 5 cm, less than about 3 cm, or less than about 2 cm.

In the speaker system, the at least 4, 6, 8 or 10 speaker drivers may be substantially identical.

Moreover, the speaker drivers of said speaker driver groups may be substantially identical.

By "substantially identical" is meant that the speaker drivers have substantially the same characteristics.

The speaker drivers may be positioned in a side-by-side arrangement.

However, the speakers may be slightly offset from each other in an axial direction and/or slightly angled relative to a front plane of the speaker cabinet.

The speaker drivers belonging to the first speaker driver group may be positioned at a central point of the speaker arrangement.

At least one of the speaker drivers belonging to the second speaker driver group may be positioned at a larger distance from the central point than all speaker drivers of the first speaker driver group.

By mounting the speakers in a concentric manner with the speaker driver(s) for the highest frequencies arranged in the central portion and speaker drivers for higher frequencies arranged in groups having the same radial distance to the centre, it is possible to control the distribution of the sound waves.

For example, the distance may be about one half or about one fourth of a minimum wavelength of the second speaker driver group.

A third speaker driver group, comprising at least one speaker driver and an amplifier may be provided. In such embodiment, at least one speaker driver of the third group may be positioned at a larger distance from the central point than all speaker drivers of the second speaker driver group.

The speaker drivers may be arranged substantially as a two-dimensional array.

However, some displacement between rows/columns and some displacement along plane normal is contemplated.

The speaker drivers may be arranged substantially as a one-dimensional array.

However, some diversion from a straight line is contemplated.

In one embodiment, the first and second signals differ with respect to phase and/or delay.

The speaker drivers of at least one, preferably both, of the speaker driver groups, may be arranged substantially in a common plane.

The speaker drivers of at least one, preferably both, of the speaker driver groups, are arranged such that their normal directions are substantially parallel. The term "normal directions" relate to a plane forming the front of the speaker driver. Hence, the speaker drivers may face parallel directions.

At least one of first and second signals may be a digital signal.

At least one of first and second amplifiers is a Class-D amplifier.

At least one amplifier may be effectively directly connected to its associated speaker driver.

By "effectively directly connected" is meant that there are no components arranged to modify the signal on its way from the amplifier to the speaker driver.

All speaker drivers of at least one of the first and second speaker driver groups may be arranged to receive effectively the same signal.

By "effectively the same signal" is understood that there are no components arranged to modify the signal on its way from the amplifier to any one of the speaker drivers.

The digital signal processor may be arranged to provide different signals to at least two speaker drivers forming part of the same speaker driver group. In one embodiment, a delay may be provided between the signals provided to said at least two speaker drivers forming part of the same speaker driver group.

In one embodiment, one or more speaker drivers may be provided with a signal having a smallest delay, and speaker drivers arranged at a distance from the speaker drivers having the smallest delay may be provided with a respective signal having a greater delay.

According to a second aspect, there is provided a method for providing sound to a listener, in a speaker system comprising a first speaker driver group, comprising at least one first speaker driver and a first amplifier, and a second speaker driver group, comprising at least one second driver and a second amplifier. The method comprises providing, by means of a digital signal processor, a first signal to the first speaker driver group and a second signal to the second signal group. The first and second signals differ with respect to frequency range.

The first and second signals may be provided by receiving a signal from a sound source, and inverse filtering the signal from the sound source based on a model of the speaker system, after which the signals may be fed to the amplifier.

The model may be formed based on measurement of frequency response of the speaker system.

The method may further comprise providing a delay between the signals provided to at least two speaker drivers within at least one of the speaker driver groups.

The method may further comprise providing one or more speaker drivers with a signal having a smallest delay, and speaker drivers arranged at a distance from the speaker drivers having the smallest delay may be provided with a respective signal having a greater delay.

DESCRIPTION OF EMBODIMENTS

Figure 1:
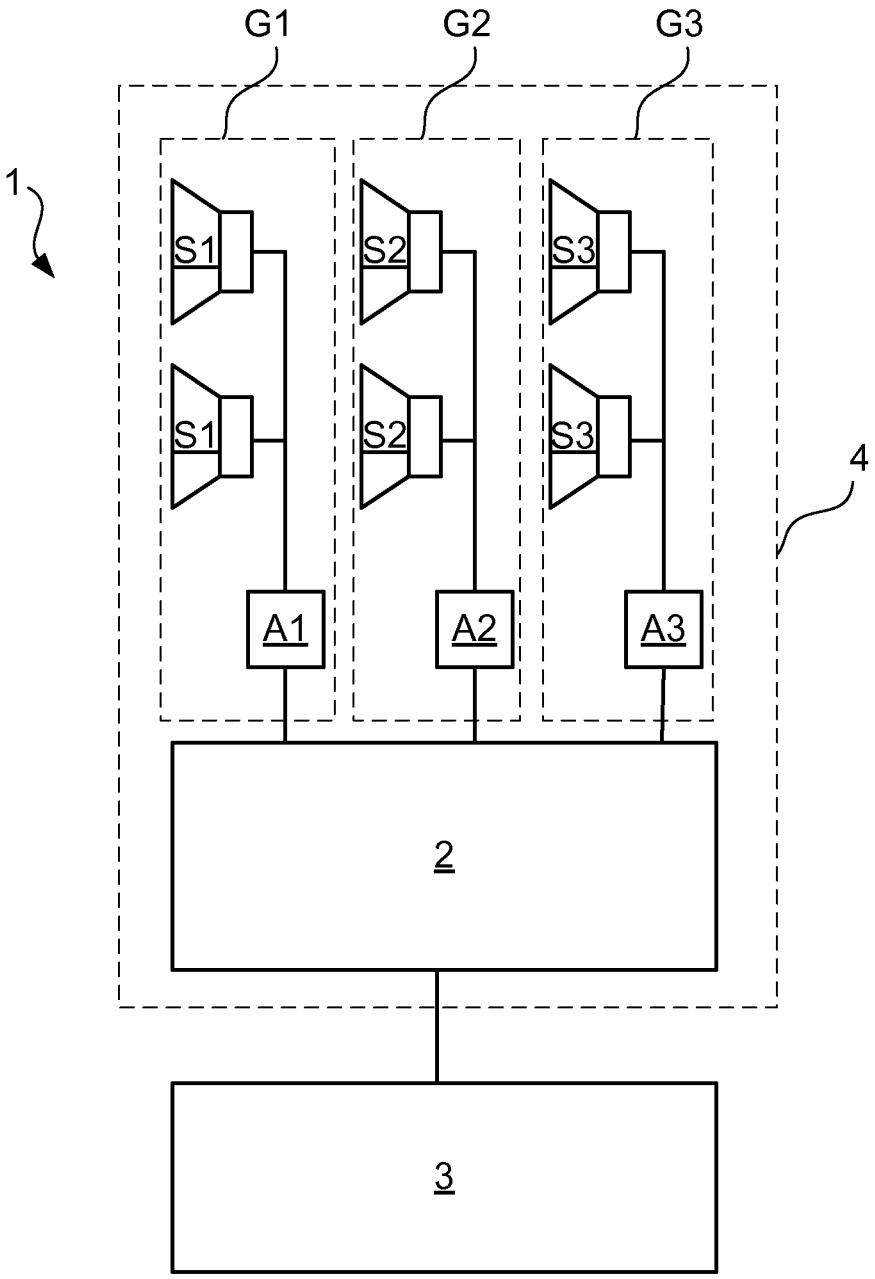
FIG. 1 is a schematic diagrammatic view of a speaker system.

FIG. 1 illustrates a schematic diagram of a speaker system 1, comprising a digital signal processor ("DSP") 2 and a plurality of speaker driver groups G1, G2, G3. The system is connected to a sound source 3, which may be any type of sound source, such as a CD/DVD/BlueRay® player, an mp3 player, record player, tape recorder, wireless media player etc. The speaker driver groups are arranged in a cabinet 4, in which also the DSP 2 and/or sound source 3 may optionally be arranged.

Each speaker driver group G1, G2, G3 comprises at least one amplifier A1, A2, A3 and at least one speaker driver S1, S2, S3. All speaker drivers within one speaker driver group are provided with the same drive signal. All speaker drivers within one speaker driver group G1, G2, G3 may be substantially identical. Moreover, all speaker drivers of the speaker system 1 may be substantially identical. In the alternative, different types of speaker drivers may be used in different speaker driver groups.

Dynamic loudspeakers may be used as speaker drivers S1, S2, S3. Preferably, the speaker drivers should be selected such that the magnet size and membrane size cause it to operate substantially as a rigid piston without internal vibrations.

The speaker drivers may be selected such that a radius and a depth of the speaker drivers of at least one speaker driver group is approximately equal. In any event, the thickness and depth should differ less than about 25%, less than about 15% or less than about 5%.

The speaker drivers of said at least one speaker driver group may present a diameter less than about 5 cm, less than about 3 cm, or less than about 2 cm, and thus a thickness which is less than about 5 cm, 3 cm or 2 cm, respectively. A specifically contemplated embodiment may make use of 1 inch thick speaker drivers. Each speaker driver group G1, G2, G3 is arranged to receive a respective signal from the DSP 2. Each signal may present a unique frequency range, phase and delay.

It is understood that the DSP 2 may receive a plurality of channels from the sound source 3, e.g. 2 channels for a stereo signal, 6 channels for a 5.1 surround system or 8 channels for a 7.1 surround system. Each channel may be processed by the DSP 2 and fed to one or more speaker systems 1, 1', 1". In the alternative, multiple signals may be fed to the same speaker system 1, 1', 1".

For example, the first speaker driver group G1 may be provided with a first signal representing an uppermost frequency range, e.g. 5000-20000 Hz; the second speaker driver group G2 may be provided with a signal representing a middle frequency range, e.g. 1000-5000 Hz; and the third speaker driver group G3 may be provided with a signal representing a lowermost frequency range, e.g. 20-1000 Hz. The system may comprise at least two speaker driver groups, up to an arbitrary number of speaker driver groups, such as 3, 4, 5, 6, 7 or 8, or higher.

It is known that for sound travelling in air, $\lambda=v/f$, where $\lambda$ is the wavelength, v is the speed of sound, and f is the frequency.

A speaker system according to the present disclosure may be designed such that a ratio of total effective speaker driver area to minimum wavelength is substantially equal for all speaker driver groups. Thus, when using a plurality of identical speaker drivers for all speaker driver groups G1, G2, G3, the number of speaker drivers will increase with increasing wavelength. In the example above, the frequency range for the first speaker driver group G1 is 3000-20000 Hz, providing a minimum wavelength of approximately 343/20000 m≈17 mm; the frequency range for the second speaker driver group G2 is 1000-3000 Hz, providing a minimum wavelength of approximately 343/3000 m≈114 mm; and the frequency range for the third speaker driver group G3 is 20-1000 Hz, providing a minimum wavelength of approximately 343/1000 m=343 mm.

Figure 2:
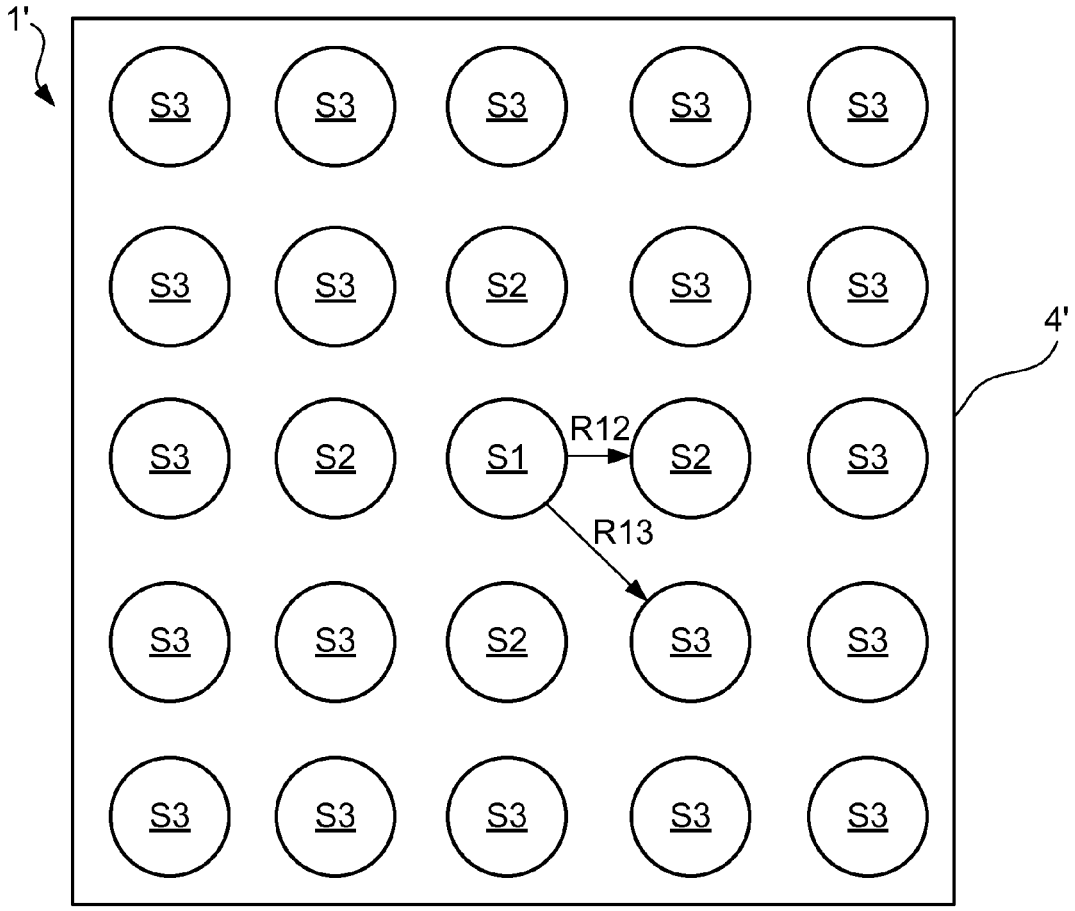
FIG. 2 is a schematic planar view of a speaker unit comprising three speaker driver groups, where the speaker drivers are arranged as a two-dimensional array.

It's known that the directivity of a wave is related to the area of the surface emitting said wave. Hence, this array configuration can provide a more even energy distribution over off-axis angles for the entire audible frequency spectrum compared to a conventional loudspeaker. An example for the frequencies above is shown in FIG. 2, where S1 should be around 17 mm in diameter, R12 around 114/2 mm (for corresponding array diameter) and R13 around 343/2 mm (for corresponding array diameter). The number of drivers are not important, but they must be significantly smaller then the wavelength for which they should cooperate as one emitting surface. For shorter wavelengths they will interfere as individual point sources.

The lowest frequencies will always be emitted as a sphere for any reasonably sized emitting area.

Hence a speaker may be formed with a plurality of relatively small speaker drivers. It is understood, that if fed directly from a normal amplifier, such a speaker will not provide very good sound quality, especially in respect of lower frequencies.

The DSP 2 may be used in order to compensate for the acoustic shortcomings of the speaker drivers. Hence, the DSP may be provided with FIR, warped FIR and/or IIR filters, and a model for compensating for the acoustic shortcomings of the speaker system. In one embodiment, different filter types may be used for different frequency ranges, e.g. IIR filters for the lower frequency range and FIR filters for the higher frequency range. It is known how to prepare such a model from the articles Norcross, S. et al.: *Subjective Investigations of Inverse Filtering*, J. Audio Eng. Soc., Vol. 52, No. 10, 2004 October and Kirkeby, O. & Nelson, P.: *Digital Filter Design for Inversion Problems in Sound Reproduction*, J. Audio Eng. Soc., Vol. 47, No. 7/8, 1999 July/August, the entire contents of which are incorporated by reference herein.

Hence, once assembled, the speaker's frequency response may be measured, e.g. as described in the article Farina, A.: *Simultaneous Measurement of Impulse Response and Distortion with a Swept-Sine Technique*, Audio Engineering Science Preprint, Presented at the 108th Convention 2000 Feb. 19-22 Paris, France, the entire contents of which is incorporated by reference herein.

Hence, with knowledge of a relationship between a desired frequency response and an actual frequency response of the speaker system, the DSP 2 may modify the signal from the sound source 3, divide it into predetermined frequency ranges, which are to be fed to a respective one of the amplifiers A1, A2, A3 with any delay, phase shift and/or gain required for the respective speaker driver group G1, G2, G3, such that the signal provided to each amplifier A1, A2, A3 is a signal, which when presented to a user will provide a sound quality, which is markedly better than that obtainable by feeding the sound source signal directly to the amplifiers A1, A2, A3, without processing in the DSP.

The DSP is preferably integrated into the speaker cabinet together with the amplifiers, such that the sound source 3 is connectable directly to the speaker system. The connection may be analogue or digital, with or without gain control.

The amplifiers may be any type of amplifiers. However switching amplifiers, such as Class-D amplifiers, may be recommended because their relatively high efficiency will minimize heat losses, which is particularly advantageous when the amplifiers are built into the same cabinet 4 as the speaker drivers S1, S2.

FIG. 2 schematically illustrates a front of a speaker system 1', where a plurality of speaker drivers S1, S2, S3 are arranged in a common cabinet 4', as a two-dimensional array. The first speaker driver group G1 here comprises only a single speaker driver S1, while the second speaker driver group G2 comprises four speaker drivers S2, all arranged at a radial distance R12 from the first speaker driver S1. The third speaker driver group G3 comprises 20 speaker drivers S3, the most central ones being arranged a radial distance R13 from the first speaker driver S1. In this embodiment, the most proximal speaker driver S3 of the third speaker driver group G3 is positioned farther away from the first speaker driver S1 than the most distal speaker driver S2 of the second speaker driver group G2.

Figure 3:
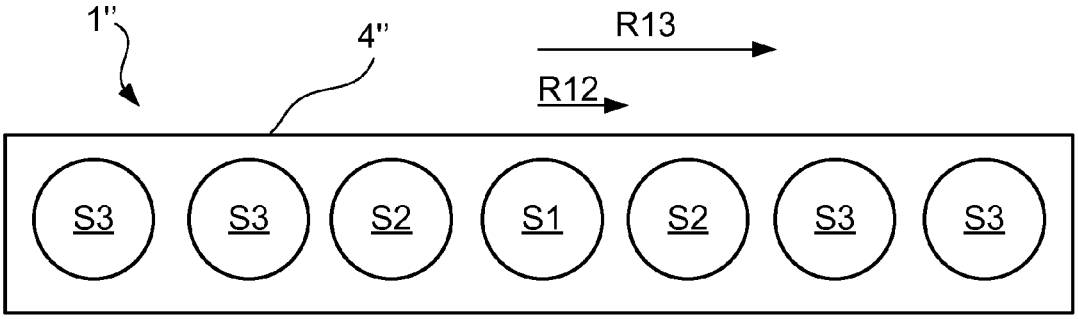
FIG. 3 is a schematic planar view of a speaker unit comprising three speaker driver groups, where the speaker drivers are arranged as a one-dimensional array.

FIG. 3 schematically illustrates a front of a speaker system 1", where a plurality of speaker drivers S1, S2, S3 are arranged in a common cabinet 4", as a one-dimensional array. The first speaker driver group G1 here comprises only a single speaker driver S1, while the second speaker driver group G2 comprises two speaker drivers S2, both arranged at a radial distance R12 from the first speaker driver S1. The third speaker driver group G3 comprises four speaker drivers S3, the most central ones being arranged a radial distance R13 from the first speaker driver S1. In this embodiment, the most proximal speaker driver S3 of the third speaker driver group G3 is positioned farther away from the first speaker driver S1 than the most distal speaker driver S2 of the second speaker driver group G2.

The speaker system 1" may be positioned horizontally or vertically.

The array construction gives other unexpected advantages than just the fact that the speaker can be made flat. By having a number of independent speakers working together, the wave form can be very precisely controlled, e.g. as described in WO02071796A1. This invention however, is not about sending the sound in different directions by delaying the speakers individually, although this is a possibility. Instead the array can be used to make the speaker work better in a normal home listening environment.

To achieve a good listening experience in a home environment, reflections from walls, ceiling and floors may need to be taken into account, since the sound heard by the listener is a mix of direct sound from the loudspeaker driver and these reflections.

A normal loudspeaker may be tuned (for example using a DSP) to have a perfect on-axis frequency response. However, it is very hard to mechanically design a speaker that will have the same frequency response off-axis, due to its geometric properties.

By using the array in a specific way, the off-axis behavior can be controlled better than with a single speaker driver.

By letting only one or a few speakers in the center of the array play the highest frequencies, the ones closest to these play midrange frequencies and the outer speakers only play the lowest frequencies, the sound energy can be more evenly emitted in different angles from the speaker over the entire frequency range. This is because the wave directivity differs as a function of wavelength versus membrane size.

Thus, an array speaker can have better off-axis frequency response, which results in a better listening experience in a home environment.

Having a co-axial sound source as suggested here also eliminate the off-axis interference that normally appears between a separated high frequency speaker driver (tweeter) and low frequency speaker driver (woofer).

Another approach for increased sound quality in a home environment is to minimize wall reflections, to avoid hearing the off-axis frequency response. As a result of the multiple speaker design, a plane wave can be created for the higher frequencies by using the drivers as one big single membrane. That can be achieved by letting all speaker drivers play exactly the same full-range sound. That way frequencies corresponding to wavelengths smaller than the total membrane size will act as plane waves with a high directivity.

However, for practical reasons a very high directivity is not wanted in most home audio applications, since it requires that the listener is positioned exactly on-axis in relation to the speakers. One way of minimizing room reflections and still keeping a wide listening position, is to use a one dimensional array, as illustrated in FIG. 3. This gives a plane wave on the vertical axis, minimizing floor and ceiling reflections, while it acts as a point source giving a wide sound dispersion on the horizontal axis.

It is understood that a very large number of speaker drivers may be used. For example, one speaker system may comprise a total of 48 speaker drivers mounted as a two-dimensional array. The speaker drivers may be divided into three speaker driver groups, with about 1-4 speaker drivers forming a first speaker driver group for the highest frequency range; about 4-10, 15 or 20 speaker drivers forming a second speaker driver group and about 10-35 speaker drivers forming the third speaker driver group.

In one embodiment, a speaker driver group comprising more than two, preferably 3 or more, speaker drivers, may be supplied with a signal presentling a specific frequency range. This signal may be subject to a delay processing, wherein an individual delay for each speaker driver, or subgroup of speaker drivers, is provided.

This could be particularly advantageous in a linear array of speaker drivers, which, where all speaker drivers are fed the same signal, would provide a highly directional wave, in at least one direction. For example, a vertically arranged linear array of 1×5 speaker elements, would, when the same signal is supplied to all speaker drivers, provide a wave having an acceptable propagation in the horizontal direction, but a very limited propagation in the vertical direction. Hence, a listener positioned vertically below or above the extension of an outermost speaker driver, would receive a less satisfactory listening experience.

By introducing a delay, which increases from e.g. a substantially centrally located speaker driver and outwardly toward the speaker's front edge, the wave propagation in the vertical direction can be improved. This type of solution may be particularly suitable for use with signals providing the treble range, i.e. for the signal providing the highest frequency range of the system.

Hence, the digital signal processor may be arranged to provide two signals having the same frequency range, but being delayed relative to each other. Moreover, each speaker driver group may comprise as many amplifiers as there are differently delayed signals.

This is particularly advantageous when making very thin, flat speaker cabinets, as disclosed herein.

The delay may be introduced digitally, in the DSP, in a manner which, per se, is known to the skilled person.

An embodiment with five speaker drivers arranged in a substantially linear array and being provided with the same frequency range, thus forming a speaker driver group may be divided into three sub groups, with the central speaker driver being supplied with a signal having 0 delay, the two speaker drivers adjacent the central speaker driver being supplied with a signal having a first delay and the two outermost speaker drivers being supplied with a signal having a second, greater delay. All three signals have the same frequency range and the three differently delayed signals being supplied via a respective amplifier.

An arrangement as described above is particularly advantageous for arrays which have a mainly vertical extent, i.e. speakers where the speaker drivers are positioned one above the other forming one, two or three, substantially vertical rows, where the speakers will operate as a point source, as seen horizontally, but provide a narrow beam in the vertical direction, thus causing a need for a "beam widening" by the delay to provide better sound above and/or below the beam otherwise formed. It is noted that where such delay-based beam widening is used, speaker drivers supplied with signals of a different frequency range but arranged at a distance from the speaker driver having the shortest delay will also need to be delayed. Thus, additional amplifiers will need to be provided for each delay group of such frequency range.

Hence, the speaker drivers may be provided delayed signals so as to emulate speaker elements positioned on a convex arc, even though they are actually positioned on a flat or substantially flat surface.

The invention claimed is:

1. A speaker system, comprising:

a first speaker driver group, comprising at least one first speaker driver and a first amplifier, and a second speaker driver group, comprising at least one second speaker driver and a second amplifier, a digital signal processor, adapted to provide a first signal to the first speaker driver group and a second signal to the second speaker driver group, wherein the first and second signals differ with respect to frequency range, and wherein at least one of the speaker driver groups comprises at least 4, 6, 8 or 10 speaker drivers;

wherein for all speaker driver groups a ratio of total effective speaker driver area to minimum wavelength of the signal is equal; and wherein for all speaker driver groups the speaker drivers have the same characteristics.

2. The speaker system as claimed in claim 1, wherein the speaker drivers of said at least one speaker driver group present a diameter less than about 10 cm, less than about 8 cm, less than about 5 cm, or less than about 3 cm.

3. The speaker system as claimed in claim 1, wherein said at least 4, 6, 8 or 10 speaker drivers have the same characteristics.

4. The speaker system as claimed in claim 1, wherein the first and second signals differ with respect to phase and/or delay.

5. The speaker system as claimed in claim 1, wherein the speaker drivers of at least one of the speaker driver groups, are arranged substantially in a common plane.

6. The speaker system as claimed in claim 1, wherein the speaker drivers of at least one of the speaker driver groups, are arranged such that their normal directions are substantially parallel.

7. The speaker system as claimed in claim 1, wherein the speaker drivers are positioned in a side-by-side arrangement.

8. The speaker system as claimed in claim 7, wherein the speaker drivers belonging to the first speaker driver group are positioned at a central point relative to the second speaker drivers.

9. The speaker system as claimed in claim 8, wherein at least one of the speaker drivers belonging to the second speaker driver group is positioned at a larger distance from the central point than all speaker drivers of the first speaker driver group.

10. The speaker system as claimed in claim 9, wherein the distance is less than one half of a minimum wavelength of the second speaker driver group.

11. The speaker system as claimed in claim 9, further comprising a third speaker driver group, comprising at least one speaker driver and a third amplifier, wherein at least one speaker driver of the third speaker driver group is positioned at a larger distance from the central point than all speaker drivers of the second speaker driver group.

12. The speaker system as claimed in claim 9, wherein the distance is less than one fourth of a minimum wavelength of the second speaker driver group.

13. The speaker system as claimed in claim 1, wherein the digital signal processor is arranged to provide different signals to at least two speaker drivers forming part of the same speaker driver group.

14. The speaker system as claimed in claim 13, wherein a delay is provided between the signals provided to said at least two speaker drivers forming part of the same speaker driver group.

15. The speaker system as claimed in claim 1, wherein one or more speaker drivers are provided with a signal having a smallest delay, and wherein speaker drivers arranged at a distance from the speaker drivers having the smallest delay are provided with a respective signal having a greater delay.

16. A method for providing sound to a listener, in a speaker system comprising:

a first speaker driver group, comprising at least one first speaker driver and a first amplifier, and a second speaker driver group, comprising at least one second driver and a second amplifier, wherein for all speaker driver groups a ratio of total effective speaker driver area to minimum wavelength of the signal is equal, and wherein for all speaker driver groups the speaker drivers have the same characteristics, the method comprising:

providing, by means of a digital signal processor, a first signal to the first speaker driver group and a second signal to the second signal group, wherein the first and second signals differ with respect to frequency range.

17. The method as claimed in claim 16, wherein the first and second signals are provided by:

receiving a signal from a sound source, inverse filtering the signal from the sound source based on a model of the speaker system.

18. The method as claimed in claim 17, wherein the model is formed based on measurement of frequency response of the speaker system.

19. The method as claimed in claim 16, further comprising providing one or more speaker drivers with a signal having a smallest delay, and wherein speaker drivers arranged at a distance from the speaker drivers having the smallest delay are provided with a respective signal having a greater delay.

* * * * *